US009115944B2

(12) United States Patent
Arif et al.

(10) Patent No.: US 9,115,944 B2
(45) Date of Patent: Aug. 25, 2015

(54) SYSTEM AND METHODS FOR FIREARM SAFETY ENHANCEMENT

(71) Applicants: Adeel Arif, Philadelphia, PA (US); Abhishek Misra, Bellevue, WA (US)

(72) Inventors: Adeel Arif, Philadelphia, PA (US); Abhishek Misra, Bellevue, WA (US)

( * ) Notice: Subject to any disclaimer, the term of this patent is extended or adjusted under 35 U.S.C. 154(b) by 0 days.

(21) Appl. No.: 14/222,741

(22) Filed: Mar. 24, 2014

(65) Prior Publication Data

US 2014/0366421 A1 Dec. 18, 2014

Related U.S. Application Data

(60) Provisional application No. 61/836,641, filed on Jun. 18, 2013.

(51) Int. Cl.
*F41A 17/00* (2006.01)
*F41A 17/06* (2006.01)
*F41A 17/46* (2006.01)

(52) U.S. Cl.
CPC ..... *F41A 17/063* (2013.01); *F41A 17/00* (2013.01); *F41A 17/46* (2013.01)

(58) Field of Classification Search
CPC ..... F41A 17/46; F41A 17/00; F41A 17/063
USPC ..... 42/70.06, 70.07, 70.11
See application file for complete search history.

(56) References Cited

U.S. PATENT DOCUMENTS

| | | | | |
|---|---|---|---|---|
| 6,226,913 | B1 * | 5/2001 | Haimovich et al. | 42/1.01 |
| 6,415,542 | B1 | 7/2002 | Bates et al. | |
| 8,127,482 | B2 | 3/2012 | O'Shaughnessy et al. | |
| 2005/0262751 | A1 * | 12/2005 | Leslie | 42/70.01 |
| 2007/0180749 | A1 * | 8/2007 | Schumacher et al. | 42/70.01 |

FOREIGN PATENT DOCUMENTS

EP 2 749 833 A2 * 7/2014

* cited by examiner

*Primary Examiner* — Stephen M Johnson

(57) ABSTRACT

The present invention relates to system and methods for providing enhanced firearm safety by utilizing an electronic firearm locking device present in the firearm, in communication with a mobile application of a wireless mobile communication device and a remote firearm management server that provides five levels of safety for selective and dynamic enabling and disabling of the firearm based on real time situations along with several value added features.

17 Claims, 7 Drawing Sheets

SYSTEM AND METHODS FOR FIREARM SAFETY ENHANCEMENT

CROSS-REFERENCE TO RELATED APPLICATIONS

This application claims the benefit of U.S. Provisional Application No. 61/836,641, filed Jun. 18, 2013, the contents of which are incorporated herein by reference.

FIELD OF THE INVENTION

The present invention relates to a system and methods for enhancing the safety features of a firearm, more specifically, for preventing its unauthorized firing in a prohibited area.

BACKGROUND OF THE INVENTION

Safety issues have utmost priority in the context of consistent illegal gun crime happening in the different states of the USA and around the world. Considering the increased incidents of mass shooting in recent times at vulnerable targets such as educational institutions, health institutions, community centers and theaters, it is a major concern to prevent unauthorized firing of guns and other firearms to ensure the safety of the people present in the area.

In this backdrop, there is a need to address the above mentioned concern and provide a system which can prohibit such instances in the future without prejudicing people's right to own firearms.

Though it is a right of every citizen to own firearms for personal safety, there is a strong need have a system that can help in law enforcement by possessing a robust authentication system to allow the firing of the firearm, and to verify the location of the firearm at any given time to avoid its misuse in a prohibited area. The system needs to have features that can selectively enable and disable the working of a firearm in a specified geographical area.

Below are given some prior art references. U.S. Pat. No. 6,415,542, issued on 9 Jul. 2002, titled, "LOCATION-BASED FIREARM DISCHARGE PREVENTION" describes a firearm, program product and method that collectively utilize an on-board location sensor (e.g., a GPS receiver) and stored location information to selectively inhibit discharge of a firearm based on its current location. The location information identifying one or more prohibited locations is stored in the firearm itself. However, this system does not provide a dynamic method for enabling and disabling of the firearm depending on the real time situation and location and does not verify the identity of the person using the firearm.

U.S. Pat. No. 8,127,482, issued on Mar. 6, 2012, titled, "SAFETY SYSTEM FOR FIREARMS" describes a firearm enabling and disabling electronic system which is configured to work within a predetermined distance only.

None of the known prior art references provide a robust, secure and flexible system and methods for selective enabling and disabling of firearms depending on real time situational demands.

BRIEF SUMMARY OF THE INVENTION

The system and methods in accordance with the present invention provide a robust and secure solution that ensures that neither the firearms are misused nor the safety of the firearm owner and other people is compromised at any time.

The present invention utilizes a combination of multiple security levels to provide dynamic and selective enabling and disabling of the fire arm.

Presently disclosed are dynamic and secure methods of electronically locking and unlocking of firearms based on real time conditions in a specific geographical location. The invention is directed to hardware, systems, methods, programs, computer products, computer readable media, wireless mobile communication devices, applications and modules for remotely controlling the selective enabling and disabling of firearms.

It is therefore an object of the present invention to provide system and methods for safety enhancement in firearm by selectively disabling it when present in an unauthorized geographical area and also notifying the law enforcement agencies regarding request for enabling it in the unauthorized area.

It is another object of the present invention to provide enhanced safety features in firearm by selectively enabling it even when it is present in an unauthorized geographical area on detecting a potential risk in the form of one or more enabled firearms present in the vicinity.

A further object of the present invention is to check if the emotional state of the user (authorized firearm owner) is fine and if he has any prior history of mental health related issues that could pose potential risks to the safety of other people.

Another object of the present invention is to retrofit existing firearms with the safety features provided by the present invention.

A further object of the present invention is to provide analytical data to law enforcement agencies based on the firearm enabling and disabling information in a specified geolocation.

A still further object of the present invention is to ensure that a designated firearm is used by an authorized firearm owner only.

Another object of the invention is to prevent any case of accidental or unintended firing of the firearm.

These objects and their several variants are achieved by providing a combination of multiple levels of safety facilitated by an electronic firearm locking device located in the firearm, a smartphone based application present in a handheld wireless mobile communication device, such as a smartphone, or a wearable computing device that wirelessly communicates with a remote Firearm Management Server interfaced with an e-Health Server for locking or unlocking the firearm depending on pre-specified criteria.

The foregoing discussion summarizes some of the more pertinent objects of the present invention. These objects should be construed to be merely illustrative of some of the more prominent features and applications of the invention. Applying or modifying the disclosed invention in a different manner can attain many other beneficial results or modifying the invention as will be described. Accordingly, referring to the following drawings may have a complete understanding of the invention.

DETAILED DESCRIPTION OF THE INVENTION

The present invention comprises of a system and methods for enhanced firearm safety to manage user access of a designated firearm from a user's wireless mobile communication device (such as a smartphone or a wearable computing device), with five levels of safety, based on predetermined access rules to determine in real time, where and when a user is allowed to use a firearm.

Figure 1:
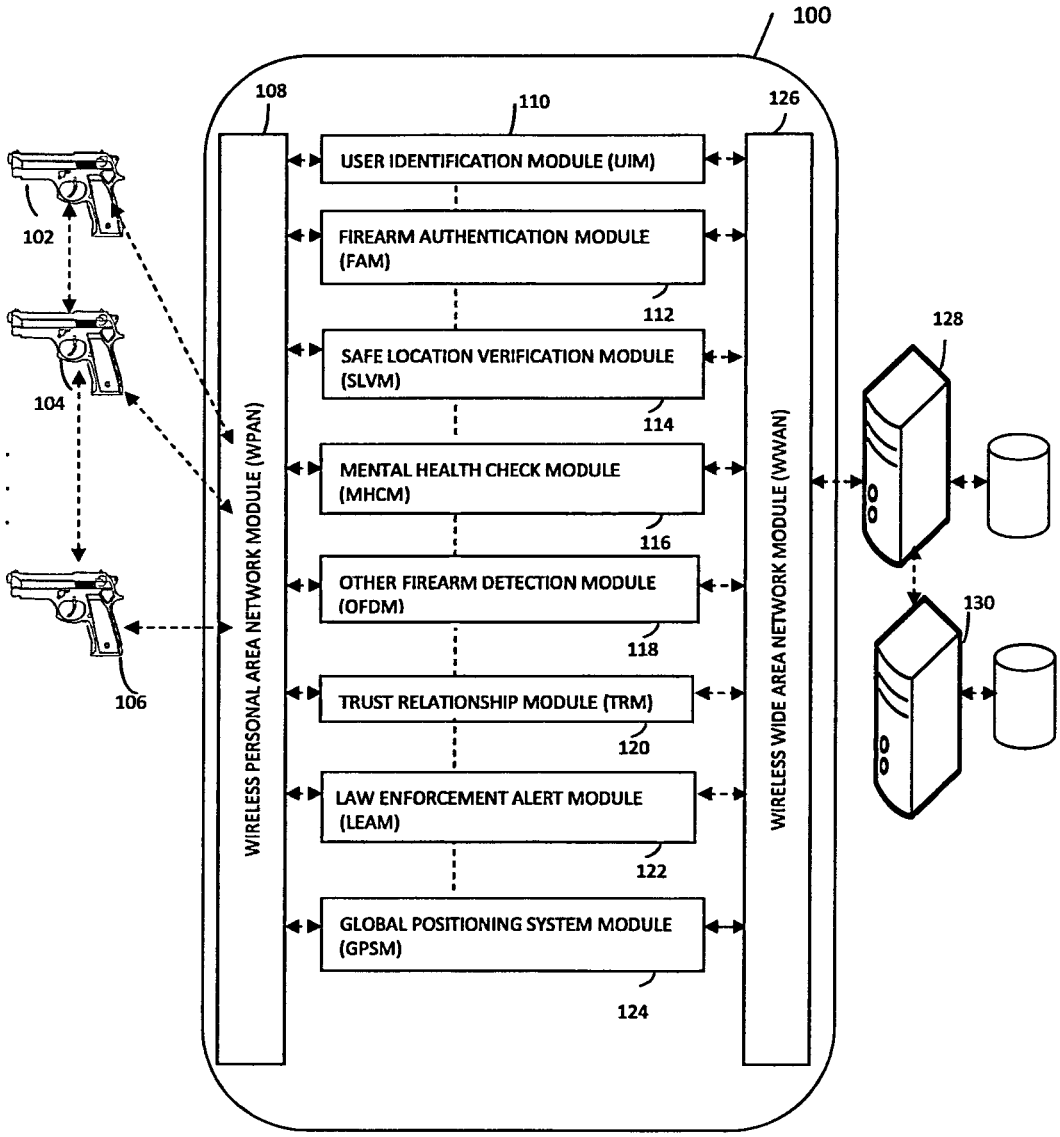
FIG. 1 is an exemplary block diagram illustrating the operating modules of the present invention.
Figure 2:
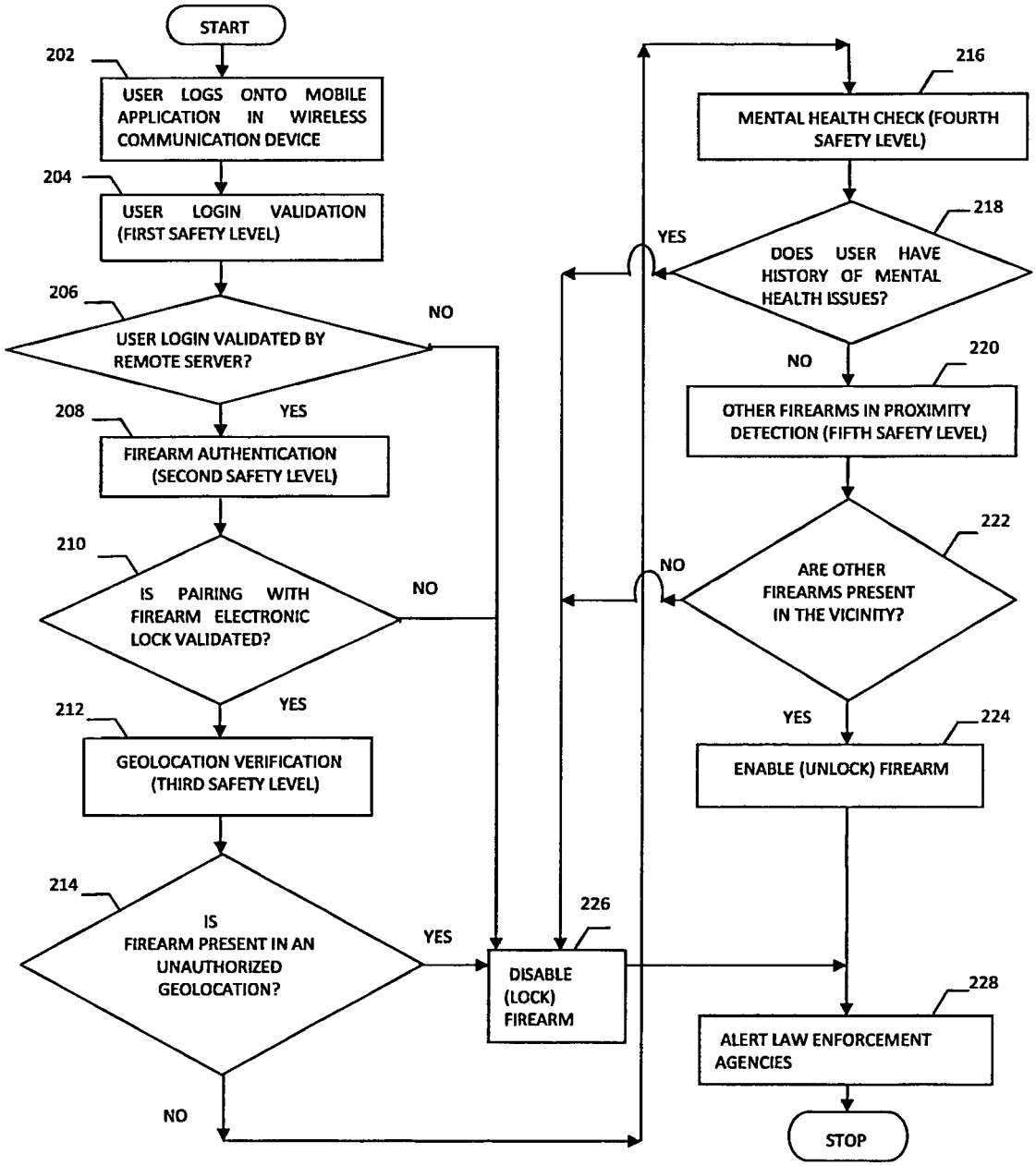
FIG. 2 is an illustrative flow chart depicting the sequence of steps of an embodiment of the present invention.
Figure 3:
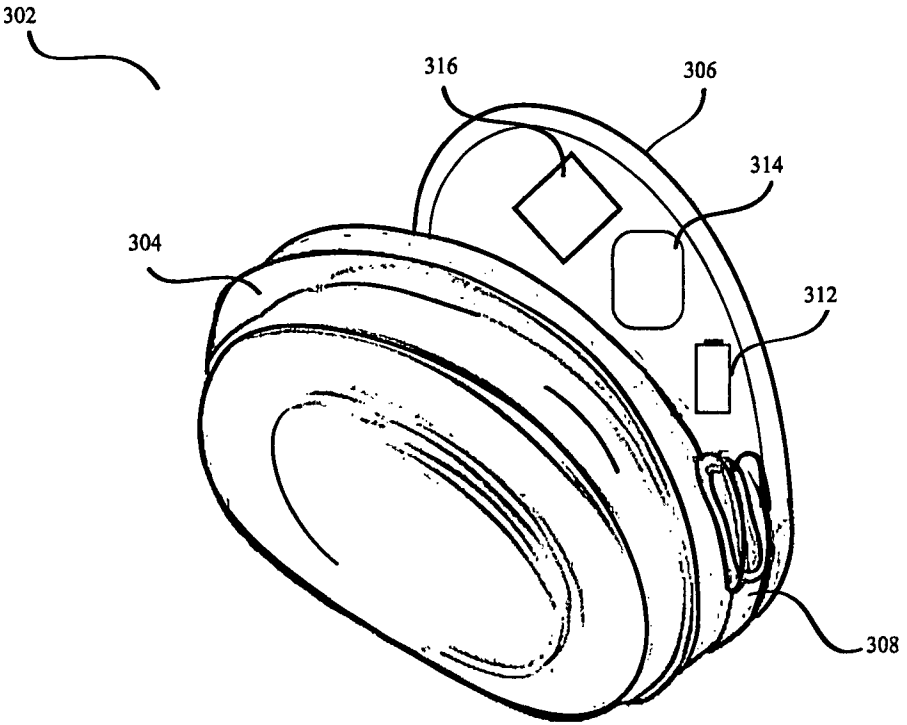
FIG. 3 illustrates an electronic locking device used in an embodiment of the present invention.

Reference to FIG. 1 through FIG. 6, a system in accordance with the present invention comprises of a mobile application residing on a wireless mobile communication device, an electronic locking device 302 located in the first firearm 102 and in the one or more other firearms 104 and 106 etc., comprising of an electronic assembly and a mechanical assembly, said electronic assembly comprising of microcontroller chip 316 electronically connected to a battery 312, said mechanical assembly comprising of two surfaces, first surface 304 and second surface 306, both shown in FIG. 3, hinged at a common edge 308, an electric motor (not shown in drawings) and a control shaft (not shown in drawings), a remote Firearm Management Server 124, a remote e-Health Server 130, wherein said electronic locking device 302 wirelessly communicates with the mobile application present on the wireless mobile communication device of the first user for first firearm 102 and of one or more other users for the one or more other firearms 104 and 106 etc., which in turn communicates wirelessly with the remote Firearm Management Server and the remote e-Health Server.

Figure 4:
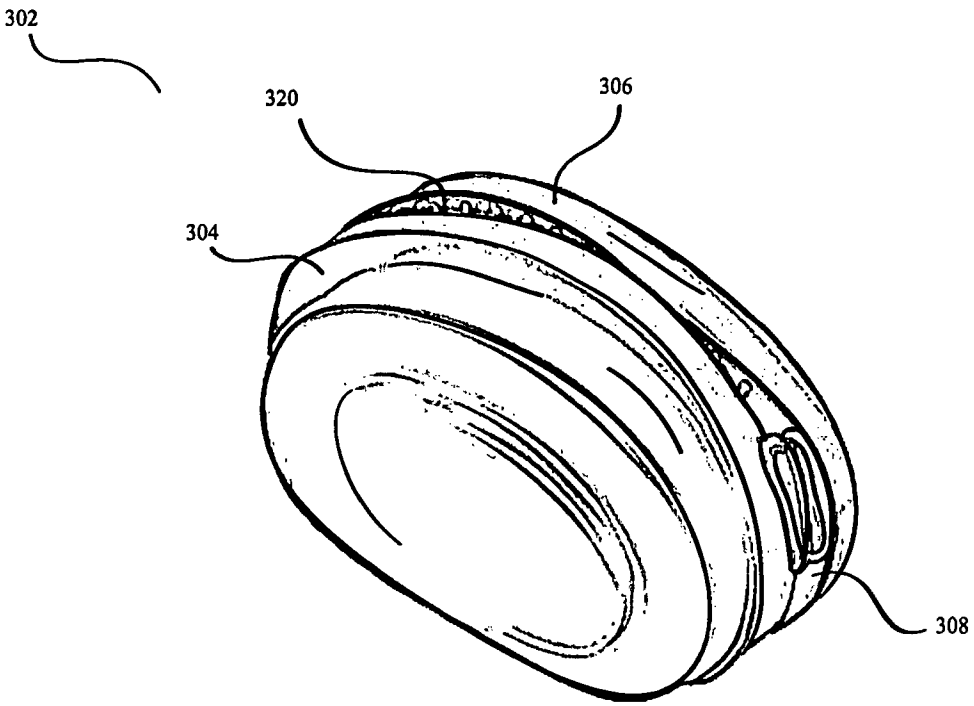
FIG. 4 illustrates the electronic locking device shown in FIG. 3 in closed condition.
Figure 5:
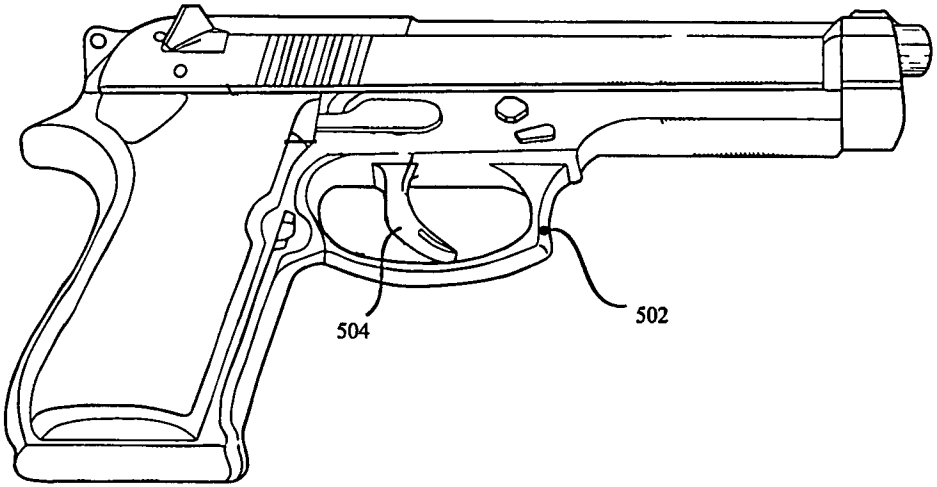
FIG. 5 illustrates a common firearm.

Said electronic locking device 302 resides in the first firearm 102 and one or more other firearms 104, 106 etc. and comprises of a mechanical assembly constituted by two surfaces, first surface 304 and second surface 306, hinged at a common edge 308 to form a cavity 320 (cavity 320 is shown in FIG. 4) that encloses the finger protector 502 and the trigger 504 of firearm shown in FIG. 5. The device further comprises of electric motor and a control shaft to enable the folding and unfolding of the two surfaces (first surface 304 and second surface 306) hinged along the common edge 308. When the two surfaces move apart the finger protector 502 and the trigger 504 present in the cavity 320 are accessible to the user and the firearm is unlocked. When the two surfaces move in towards each other, said cavity 320 is closed and the user is unable to access the finger protector and the trigger, thereby locking the firearm and inhibiting its operation. The microcontroller chip 316 wirelessly communicates with the mobile application residing in the wireless mobile communication device. The microcontroller chip 316 and battery 312 may be encased in the cavity 320 in the firearm or alternately be present outside the cavity 320.

An embodiment of the electronic locking device uses ATMega328p microcontroller chip, which has low power requirements, and therefore can be powered through AA batteries, 9V NiMH, or rechargeable Lithium ion batteries.

It is important to define several terms, phrases and acronyms before describing the invention. It should be appreciated that the following terms are used throughout this application. Where the definition of terms departs from the commonly used meaning of the term, the applicant intends to utilize the definitions provided below, unless specifically indicated:

(a) a User Identification Module (UIM) is a set of hardware and software components that validates the identity of the user (authorized firearm owner) by the mobile application by authorization methods such as entry of valid Personal Identification Number (PIN), facial or biometric authorization, thereby provides a first level of firearm safety.

(b) a Firearm Authentication Module (FAM) is a set of hardware and software components that checks the pairing of the electronic locking device with the firearm, by Near Field Communication (NFC) and/or Radio Frequency Identification (RFID) communication means, and alerting the mobile application in the event of breaking of pairing, thereby providing a second level of firearm safety.

(c) a Safe Location Verification Module (SLVM) is a set of hardware and software components that uses Global Positioning System (GPS) functionality to checks whether the current location of the firearm is in a permitted and authorized geolocation, thereby providing a third level of firearm safety.

(d) a Mental Health Check Module (MHCM) is a set of hardware and software components that checks the mental fitness and emotional state by wirelessly communicating with an e-Health server to retrieve data corresponding to prior medical history of the user, thereby providing a fourth level of firearm safety.

(e) a Other Firearm Detection Module (OFDM) is a set of hardware and software components that detect the presence of other firearms in the vicinity by Near Field Communication (NFC) and/or Radio Frequency Identification (RFID) communication means, indicating degree of potential risk to the user's safety, thereby providing a fifth level of firearm safety.

(f) a Trust Relationship Module (TRM) is a set of hardware and software components that provide a means for the user to categorize the risk level associated with other firearms in the vicinity based on the relationship of their owners with the user.

(g) a Wireless Personal Area Network module (WPAN) is a set of hardware and software components that provide communication means such as Bluetooth, Zigbee, Near Field Communication (NFC) and/or Radio Frequency Identification (RFID) for communication between the mobile application and electronic locking device in the firearm.

(h) a Wireless Wide Area Network (WWAN) module is a set of hardware and software components that connects the wireless mobile communication device to the remote Firearm Management Server.

(i) a Law Enforcement Alert Module (LEAM) is a set of hardware and software components that provides alerts to law enforcement authorities based on predetermined conditions such as presence of the firearm in an unauthorized geolocation, or an attempt to breach any of the safety levels.

(j) a User or Firearm owner are referred to in this application synonymously and interchangeably. Both these terms are to be construed to refer to the same person, i.e. the person who owns the firearm and is interested in using the same.

Referring initially to FIG. 1, the drawing depicts the operating modules of the system and methods provided for firearm safety enhancement. 100 denotes the functional modules of the mobile application residing in the wireless mobile communication device. 102, 104 and 106 depict a plurality of firearms possessing the electronic locking device of the present invention. For illustrative purposes, only three firearms are shown in the drawing, however it is to be appreciated that the same concept may be applied to any number of firearms. 108 denotes WPAN module which facilitates wireless communication between the microcontroller chip of the electronic locking device of the firearm and the wireless mobile communication device. WPAN module 108 may be implemented by wireless communication protocols known in the prior art such as Bluetooth or Zigbee or Near Field Communication (NFC) or Radio Frequency Identification (RFID). 110 denotes UIM which ensures that only an authorized user is able to login to the mobile application. User identification and login methods such as entry of secure login data, biometric, haptic, tactile signature methods or a combination thereof, may be used for establishing the identity of the user. Only an authorized user is able to login to the mobile application for unlocking the firearm. UIM 110 communicates with a remote firearm management server 124 to verify user identity through WWAN Module 126 for wireless communication through a wireless communication protocol such as internet, cellular network. 112 denotes FAM whose function is to ensure the pairing of the electronic lock on the respective firearm via component WPAN Module 108. 114 denotes SLVM which checks for the geographical coordinates of the wireless mobile communication device and the firearm via component 124 which may reside on the firearm 102, 104, 106 or the wireless mobile communication device itself, and component 126. 116 denotes MHCM which checks the mental fitness and emotional state by wirelessly communicating with a remote server, referred to as the e-Health server to retrieve data corresponding to prior medical history of the user. 118 denotes OFDM which checks for the presence of other firearms in the vicinity. 120 denotes TRM which enables the user to categorize the other firearms detected in the vicinity into different categories based on his relationship with the other firearm owners. 122 denotes LEAM which provides periodic and situational alerts to law enforcement agencies in case of breach of safety check at any of the five levels. 124 denotes the Global Positioning System Module (GPSM) which identifies the geographical coordinates of the wireless mobile communication device and in turn that of the firearm. 128 denotes the remote Firearm Management Server which is maintained by a third party and comprises of a database pertaining to information such as data of subscribers, firearm owners, safe geolocations, firearms. Also included in the database is the profile of all licensed and unlicensed firearm owners. Profile of licensed firearm owners may be received from the license issuing authorities under certain agreements, and of unlicensed owners through their voluntary declaration. 130 denotes the e-Health server which is maintained by a third party and comprises of a database pertaining to medical history related to mental health of the user, such as data provided and updated from the public health administration authority, for example on a county level and dynamically updated based on the user's visit to a medical practitioner, prescription and purchase of medicines from a pharmacy store. All operating modules are logically connected to each other, the electronic locking device of the firearm, the remote Firearm Management Server and e-Health server either directly or indirectly to provide the five safety levels in various embodiments of the present invention. These modules may be hosted locally on the user's wireless mobile communication device or on the remote Firearm Management Server and e-Health server. In an embodiment of the invention, databases pertaining to the Firearm Management Server and the e-Health server may reside on a common server.

FIG. 2 depicts an example methodology illustrating the steps followed in one embodiment of the invention. It is to be understood and appreciated that the present invention is not limited by order of steps and that some of the steps may occur in different order and/or concurrently with other steps from that illustrated here. Further, different embodiments of the present invention may optionally choose to implement any of the five safety levels, singly or in combination, and it is not mandatory to have all the five safety levels in an embodiment of the present invention. FIG. 2 depicts an embodiment wherein all the four safety levels are implemented.

Figure 6:
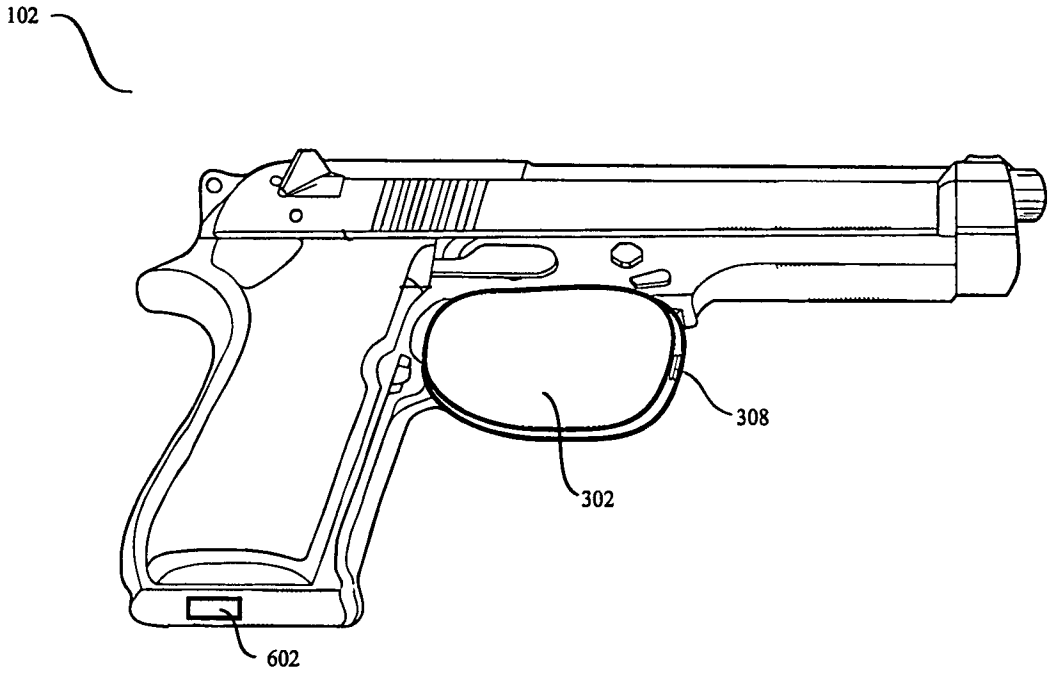
FIG. 6 illustrates a firearm with electronic locking device in accordance with an embodiment of the present invention.

Referring to FIG. 2, at step 202, the first user logs on to the mobile communication loaded on the wireless mobile communication device. At step 204, the first user login information is accepted and communicated to the remote server for verification. At step 206, the first user's login data is verified. If the first user's login id is not validated, then the first firearm 102 is disabled at step 226, followed by communication of alert to law enforcement agencies at step 228. The first firearm 102 and one or more other firearms 104 and 106 etc. possess a passive RFID tag 602 as shown in FIG. 6 which enables it to engage in near field communication (NFC) with RFID reader 314 as shown in FIG. 3 on the firearm electronic locking device 302 (302 is shown in FIG. 3, FIG. 4 and FIG. 6). This feature enables the electronic locking device 302 to "know" if it is on the respective firearm or not. If the first user's login id is successfully validated at step 206, then at step 208, the pairing between the RFID reader 314 on the firearm electronic locking device 302 and the passive RFID tag 602 on the first firearm 102 is checked. This is achieved by sending periodic pings from the electronic locking device 302 of the first firearm 102 to the RFID tag 602 on the firearm to ensure that the electronic locking device 302 is present on the respective firearm 102. If invalidated and it is found that the electronic locking device 302 is not on the respective first firearm 102, then the first firearm 102 is disabled at step 226, followed by communication of alert to law enforcement agencies at step 228. If the firearm electronic locking device 302 pairing with the first firearm 102 is successfully validated at step 210, then at step 212, the geographical location of the wireless mobile communication device, and in turn, that of the first firearm 102 is identified. At step 214, it is determined if the current location of the first firearm 102 is in a safe (authorized) zone where firearms are allowed. If it is determined that the current location of the first firearm 102 is in a prohibited area where firearms are disallowed, such as educational institutions, health institutions, community centers or movie theaters, then the first firearm 102 is disabled at step 226, followed by communication of alert to law enforcement agencies at step 228. If it is determined that the firearm location is in an unauthorized area where firearms are not allowed, then at step 216, by data pertaining to prior medical history is retrieved and accessed. At step 218, it is determined if the first user has a past history of mental health issues. If the first user has a medical history pertaining to mental health, then the first firearm 102 is disabled at step 226, followed by communication of alert to law enforcement agencies at step 228. If the first user does not possess a prior medical history related to mental health, then at step 220, possible presence of one or more other firearms such as 104 or 106 in the vicinity is determined. At step 222, if it is found that there are other firearms in proximity, posing a potential risk, then at step 224 the first firearm 102 is enabled. This is followed by step 228, when an alert is sent to law enforcement agencies.

The present invention provides great flexibility to modify the safety logic rules such that numerous real time situations are covered. For instance, in an embodiment of the present invention, the first firearm is enabled even if it is present in a geographical location where firearms are not allowed, if one or more other firearms are detected in the vicinity, posing a potential risk to the first user as an emergency situation. Also an alert to law enforcement agencies is triggered.

In another embodiment of the present invention, it may be checked if there are other firearms present in the vicinity, and further if these firearms have been enabled. This information may be used to generate an alert of a higher degree to the first firearm user as well as to the law enforcement agencies.

In another embodiment of the present invention, it is possible for third parties such as law enforcement agencies to remotely override the enabling and disabling criteria of the electronic firearm locking device.

In an alternate embodiment, the user has the option of using an emergency unlocking feature to override the disabling criteria of the electronic firearm locking device. In the event that such an option is used, an immediate alert is sent to law enforcement agencies.

In an embodiment of the present invention, the electronic locking device of the firearm comprises of passive RFID or NFC tag that gets energized by the NFC enabled interface of the wireless mobile communication device. The electronic locking device periodically pings the tag and when unable to find the firearm in the event of break of pairing, it sends an alert to mobile application. Further, said electronic locking device is able to ping RFID tags of other firearms in the vicinity and communicate the same to the mobile application.

In another embodiment, a firearm without an electronic lock may be retrofitted with a portable electronic locking device such that the mechanical assembly constituted by two surfaces hinged at a common edge to form a cavity encloses the finger protector and the trigger. The firearm locking device may be either a built in lock; or off the shelf portable electronic firearm lock retrofit to inter-operate with existing firearms.

In an embodiment of the present invention, the component 116 in FIG. 1 which denotes MHCM checks the mental fitness and emotional state by wirelessly communicating with the remote Firearm Management Server 280 which is interfaced with the e-Health server 130, in real time or at predefined periodic intervals (for e.g. on hourly or daily basis) or whenever it is detected that the location coordinates of the firearm have changed. Thus when the firearm is stationary, the caching of the mental health related medical data from the e-Health server does not take place, but if firearm mobility is detected, then the caching is triggered.

In an embodiment of the present invention, data in the e-Health server is dynamically updated based events such as, the user's visit to a medical practitioner, sale of a prescribed medicine from a certain pharmacy.

In another embodiment of the present invention, the mobile application may reside not on the wireless mobile communication device (such as a smart phone or a wearable computing device), but in the firearm itself. Such a firearm would possess a smart phone like user interface.

In an embodiment of the present invention, the mobile application may reside on any wireless mobile communication device, including but not limited to smart phone, a cellular phone, a personal digital assistant (PDA), a GPS device, a smartbook, a netbook, a notebook, an ultra-mobile personal computer, a wearable computing device (like Google Glass or iWatch).

In an embodiment of the present invention the microcontroller of the electronic locking device utilizes an ATMega328p processor.

In one embodiment of the present invention the means for authentication of the identity includes but not limited to by entering personal identification number or activating face recognition or by sensing characteristics or traits of the user by activating biometric sensor or by haptic or tactile authentication methods.

In an embodiment of the invention, there is a provision for emergency unlocking of the firearm automatically based on specified situations. The user is informed of such an emergency unlocking situation by a customized alarm in the form of a visual or audio alert. Situations which trigger automatic unlocking of the firearm while alerting the user may include, for instance, detection of one or more unlocked firearm in vicinity. The emergency unlocking method operates through wireless communication between firearms and is initiated based on geo-nearness enabled by the GPS receiver residing on the firearm or on the wireless mobile communication device peered with the firearm. Such a wireless communication may be network assisted or ad-hoc (direct peer to peer communication without involving network), where one firearm detects the nearness of the other firearm and operates emergency unlock. Network assisted, or Ad-hoc mode communications may be achieved through WWAN, WLAN/WPAN or a combination.

In an embodiment of the invention, there is provided a provision to override the electronic locking device of first firearm on detecting one or more other firearms in the vicinity. The first user is provided with features to categorize one or more other firearms based on the trust level and relationship associated with the one or more other users and the first user. Consequently if another firearm owner, who is a friend or acquaintance of the first user and who also share an interest in firearms as the first user is, is present in the vicinity, then the first user can opt to categorize the firearms of the other user into a non-risk category, such that he does not receive the alerts automatically generated by unlocking of his firearm. The user can manage his preferences and settings via the mobile application.

In alternate embodiments, the mobile application is interfaced with a dedicated website hosted by the remote Firearm Management Server. The user may set or eliminate the alerts by adding such guns into different categories. As an illustration of this feature, these categories may be classified, as $1^{st}$ degree trusted relations, $2^{nd}$ degree trusted relation, $3^{rd}$ degree trusted relation and un-trusted relations by the user. List and radar diagram, such as those shown in FIG. 4 of contact details may also be created of those who happen to visit certain jurisdictional areas carrying firearms, or happen to visit the firearm owners webpage hosted by the remote Firearm Management Server. This list of categorized connections can then be used in a number of ways by the firearm owners or by the law enforcement authorities for forensics.

The dedicated website may be provided with social media features and other interactive features to act as a portal for interaction of different firearm owners who are also subscribers of the mobile application service for enhanced firearm safety.

In addition to classifying relationship, the user has the option of inviting, declining, friending, defriending, pending, postponing via "Ask Later", choices based on the degree of trust. The dedicated website may allow users to send messages or call each other. The website can provide gated access to $1^{st}$ degree trusted relations, $2^{nd}$ degree trusted relation, $3^{rd}$ degree trusted relation and un-trusted relation, and all other users etc. User profiles have advanced privacy features to restrict or share content with other users based on degree of trust they have.

Information on the whereabouts of a lost or misplaced firearm may be optionally provided to the user or the authorized relations of the users with the GPS assistance. Lost firearm scenario may also be coupled with to a combat scenario that might have resulted in the fall of a user (for instance user injury or death during a clash). In an embodiment of the invention, user fall is detected through a fall detection sensor, and the firearm owner (user)'s emergency contact numbers are automatically alerted that a fall has been detected in an event involving an enabled firearm.

Further modifications of the present invention can include features that store various physical attributes of the user such as the user's normal and anomalous gait, voice and a change in any of these attributes can be used to generate alerts in the interest of the user's safety to entities and persons such as emergency contacts, law enforcement authorities, medical aid providers.

Another embodiment includes alerts that may also trigger sending message to the traffic light cameras to record images or start video capturing.

In an embodiment of the invention, the remote Firearm management Server database comprises of data such as firearm owner's profile (including details such as name, address, contact details, hobby, firearm profile (including details such as firearm identification no., license no., product technical and commercial specifications, manufacturer details, purchase details), information from third parties such as firearm licensing authority, health administration, relevant marketers, manufacturer, recreational shooting promoters etc.) under certain agreements that honor user private data and information from service enabler technology such as GPS, biometrics, sensors, network parameters. Some of the information fields may be mandatory and others may be optional.

In an embodiment of the present invention, the remote Firearm Management Server can access the mental health records, traffic violations, criminal background, credit score of the user and assign a value, designated as the "Firearm Usage Eligibility Score". If the value of the "Firearm Usage Eligibility Score" falls below a minimum threshold value, then an alert may be sent to the law enforcement agencies. The rights of the user to use provisions such as emergency unlock feature may or may not be restricted under such circumstances.

In an embodiment of the present invention, through the use of RFID/NFC means, the electronic locking device can also ping other firearms in the vicinity and the user is able to view the firearms present in an area around him on the mobile wireless communication device. On the smartphone app user can see the guns around them. This is depicted in an exemplary form in FIG. 4. Users can have the ability to add firearms present around them as a trusted "Friend" or "connection".

User will have the ability to unlock the gun if an untrusted gun gets nearby as security/protection measure through emergency unlocking feature.

There will also be an emergency unlock feature on the app to allow gun owners to unlock without validation but will send an alert to authorities when that happens. Authorities will stay on alert till the lock gets back on gun and clear signal is sent back.

Various value added features are possible by making modifications to different embodiments of the present invention. These include:

(k) Providing forensic services to law enforcement agencies based on firearm usage data, (l) Providing immediate alerts and messages on occurrence of a firearm related crime in a specified geolocation to other firearm owners in the neighborhood, (c) Providing firearm owner usage profile based on the service subscription, (d) Providing alerts to law enforcement agencies such as the police indicating that an approaching vehicle or a pedestrian is carrying a firearm that may need to be checked.

Alert can also be generated when several people carrying firearms proceed in the form of a procession. This can also facilitate headcounts in the procession.

Figure 7:
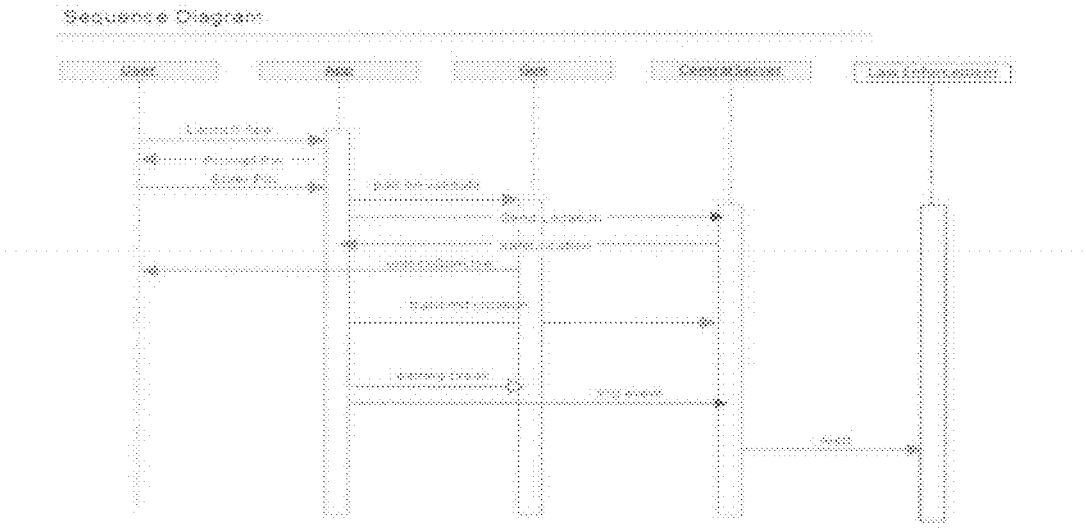
FIG. 7 is an exemplary sequence diagram illustrating the sequence of events in an embodiment of the present invention.
Figure 8:
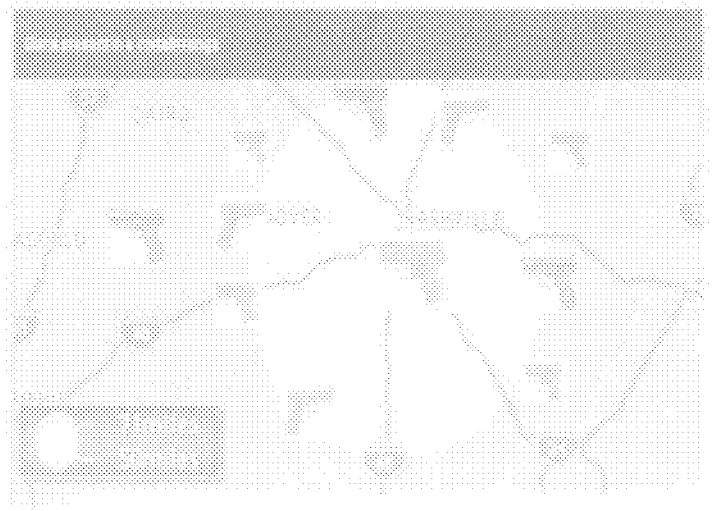
FIG. 8 is an illustration depicting a radar diagram indicating presence of other firearms in the vicinity to the user.

FIG. 7 represents a sequence diagram in an exemplary embodiment of the present invention.

Although the present invention has been particularly shown and described with reference to exemplary embodiments thereof, it will be understood by those of ordinary skill in the art that various changes in form and details may be made therein without departing from the spirit and scope of the present invention as defined by the appended claims. Therefore, the present embodiments are to be considered as illustrative and not restrictive and the invention is not to be limited to the written description.

What is claimed is:

1. A system for providing enhanced firearm safety, the system comprising:

(i) an electronic locking device located in a first firearm used by a first user and in one or more other firearms used by one or more other users, said electronic locking device further comprising of an electronic assembly and a mechanical assembly, said electronic assembly comprising of an RFID reader, a microcontroller chip electronically connected to a battery, said mechanical assembly comprising of two surfaces hinged at a common edge to form a cavity that encloses a finger protector and a trigger of said first firearm and said one or more other firearms;

(ii) a mobile application residing on a wireless mobile communication device; and (iii) a remotely networked firearm management server coupled to a remotely networked e-Health server;

wherein each of said first firearm and each of said one or more other firearms possesses a passive RFID tag and said electronic locking device wirelessly communicates with said mobile application residing on said wireless mobile communication device and said wireless mobile communication device wirelessly communicates with said remotely networked firearm management server coupled to a said remotely networked e-Health server.

2. The system for providing enhanced firearm safety as in claim 1, wherein said wireless mobile communication device is selected from a group consisting of a smart phone, a cellular phone, a personal digital assistant (PDA), a GPS device, a smartbook, a netbook, a notebook, an ultra-mobile personal computer and a wearable computing device.

3. The system for providing enhanced firearm safety as in claim 1, wherein said electronic locking device and said mobile application wirelessly communicate with each other through a wireless communication protocol selected from a group consisting of Bluetooth, Zigbee, Near Field Communication and Radio Frequency Identification.

4. The system for providing enhanced firearm safety as in claim 1, wherein said mobile application and said remotely networked firearm management server coupled to said remotely networked e-Health server communicate with each other through a wireless communication protocol selected from a group consisting of cellular network and internet.

5. The system for providing enhanced firearm safety as in claim 1, wherein, for selectively enabling and disabling said first firearm and said one or more other firearms electronically and dynamically through a five level safety check, said system further comprising of:

a. a User Identification Module (UIM) further comprising of a set of hardware and software components to validate the identity of said first user and said one or more other users by authorization methods such as entry of valid Personal Identification Number (PIN), facial or biometric authorization, designated as a first level safety check;

b. a Firearm Authentication Module (FAM) further comprising of a set of hardware and software components to checks the pairing of said electronic locking device with said mobile application by a Near Field Communication (NFC) or a Radio Frequency Identification (RFID) communication, designated as a second level safety check;

c. a Safe Location Verification Module (SLVM) further comprising of a set of hardware and software components that uses a Global Positioning System (GPS) functionality to checks whether the current location of said first firearm and said one or more other firearms are in a geographical location which is permitted and authorized, designated as a third level safety check;

d. a Mental Health Check Module (MHCM) further comprising of a set of hardware and software components that checks the mental health of said first user and said one or more other users, designated as a fourth level safety check;

e. a Other Firearm Detection Module (OFDM) further comprising of a set of hardware and software components that detect the presence of said one or more other firearms in the vicinity of said first firearm by said Near Field Communication (NFC) or said Radio Frequency Identification (RFID) communication, indicating degree of potential risk to the safety of said first user, designated as a fifth level safety check;

f. a Trust Relationship Module (TRM) further comprising of a set of hardware and software components that enables said first user to categorize the risk level associated with said one or more other firearms in the vicinity based on the relationship of said one or more other users with said first user;

g. a Wireless Personal Area Network Module (WPAN) further comprising of a set of hardware and software components that enables wireless communication between said mobile application and said electronic locking device;

h. a Wireless Wide Area Network (WWAN) further comprising of a set of hardware and software components that connects the wireless mobile communication device to said remote Firearm Management Server; and i. a Law Enforcement Alert Module (LEAM) further comprising of a set of hardware and software components that provides alerts to a law enforcement authority based on predetermined conditions such as presence of said first firearm or said one or more other firearms in said geographical location which is unauthorized, or an attempt to breach any of the safety levels.

6. The system for providing enhanced firearm safety as in claim 5, wherein said system provides a method of controlling selective enabling and disabling of said first firearm comprising:

(i) authenticating identity of said first user through said mobile application;

(ii) validating pairing between said RFID reader of said electronic locking device and said passive RFID tag present on said first firearm;

(iii) validating if said geographical location of said first firearm is a firearm permissible territory using GPS enabled functionality of said wireless mobile communication device;

(iv) validating if said first user has a prior mental health related history;

(v) checking for presence of said one or more other firearms in the vicinity of said first firearm;

(vi) categorizing risk level of said one or more other firearms based on degree of trust with said first user, (vii) sending an automatic alert to said law enforcement agency;

(viii) communicating wirelessly between said electronic locking device and said mobile application residing on said wireless mobile communication device through said WPAN module; and (ix) communicating wirelessly between said mobile application residing on said wireless mobile communication device and said remotely networked firearm management server coupled to said remotely networked e-Health server through said WWAN module.

7. The method as in claim 6, wherein said law enforcement agency is able to override the control for selective enabling and disabling of said first firearm.

8. The method as in claim 6, wherein said first user is able to override the control for selective enabling and disabling of said first firearm and said automatic alert is communicated to said law enforcement agency.

9. The system for providing enhanced firearm safety as in claim 1, wherein said mobile application is interfaced with a dedicated website hosted by said remotely networked firearm management server.

10. The system for providing enhanced firearm safety as in claim 6, wherein any injury to said first user is detected and an automatic alert is communicated to said law enforcement agency.

11. The system for providing enhanced firearm safety as in claim 1, wherein said first user is able to view said one or more other firearms in vicinity in a map displayed on said wireless mobile communication device.

12. The system for providing enhanced firearm safety as in claim 1, wherein an automatic alert is generated to said user on the wireless mobile communication device on detection of said one or more other firearms in vicinity.

13. The system for providing enhanced firearm safety as in claim 1, wherein said first firearm is automatically enabled and an automatic alert is generated to said first user on said wireless mobile communication device on detection of said one or more other firearms in vicinity.

14. The system for providing enhanced firearm safety as in claim 1, wherein said first user is able to opt to not receive an automatic alert on said wireless mobile communication device on detection of said one or more other firearms in vicinity, if said first user has categorized said one or more other firearms as those belonging to a trusted relation.

15. The system for providing enhanced firearm safety as in claim 1, wherein immediate contacts of said first user are automatically notified in event of fall detection of said first user in case of injury in an incident involving an enabled said first firearm or said one or more other firearms.

16. The system for providing enhanced firearm safety as in claim 1, wherein said first user is assigned a threshold value, designated as the "Firearm Usage Eligibility Score" based on data accessed by said remotely networked firearm management server related to mental health records, traffic violations, criminal background, credit score of said first user for restricting rights of said first user to override the disabling of said first firearm.

17. The system for providing enhanced firearm safety as in claim 6, wherein said law enforcement agency is sent one or more alerts on detection of presence of said first firearm or said one or more other firearms within said geographical location.

* * * * *